United States Patent [19]

Darling

[11] 3,970,170

[45] July 20, 1976

[54] LADDER BRIDGING DEVICE

[76] Inventor: Robert D. Darling, 13 Jay St., Gloversville, N.Y. 12078

[22] Filed: Oct. 1, 1974

[21] Appl. No.: 510,992

[52] U.S. Cl. ..... 182/230; 182/103

[51] Int. Cl.[2] ..... E06C 7/50; E06C 5/32

[58] Field of Search ..... 182/178, 104, 103, 179, 182/230; 403/309, 313, 393, 339, 340

[56] References Cited

UNITED STATES PATENTS

| | | | |
|---|---|---|---|
| 274,758 | 3/1883 | Greene | 182/206 |
| 325,381 | 9/1885 | Barkley | 182/178 |
| 363,950 | 5/1887 | Decker | 182/178 |
| 550,175 | 11/1895 | Holden | 182/178 |
| 1,003,407 | 9/1911 | Abrams | 182/178 |
| 1,458,666 | 6/1923 | Stopello | 182/178 |
| 2,308,832 | 1/1943 | Roney | 182/178 |

*Primary Examiner*—Reinaldo P. Machado

[57] ABSTRACT

This invention relates to a device useful in connection with bridging two sections of an extension ladder. The device takes the form of a sleeve structure which extends from the side rail of one section of a ladder to co-operate with the side rail of another section of the ladder. The sleeve member is guided and maintained in position by cutouts formed therein which co-operate with ladder rungs. The sleeve member has a cam portion. The invention finds use in connection with facilitating the use of a hoist or the like used with an extension ladder, and provides a smooth track for the usual wheel or roller assembly on which such hoist travels.

1 Claim, 5 Drawing Figures

FIG. 1
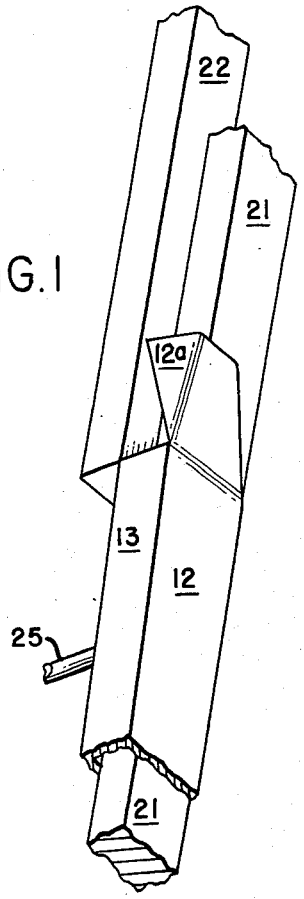
FIG. 4
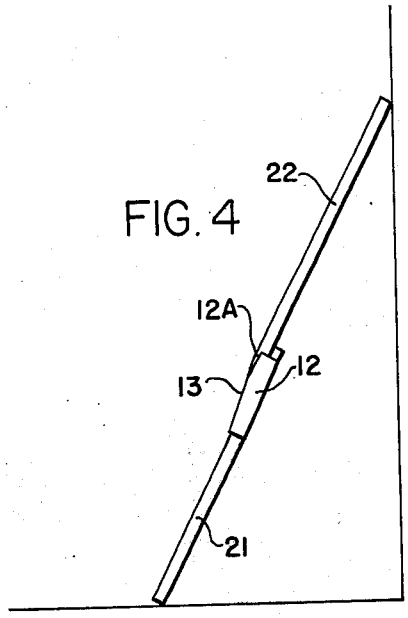
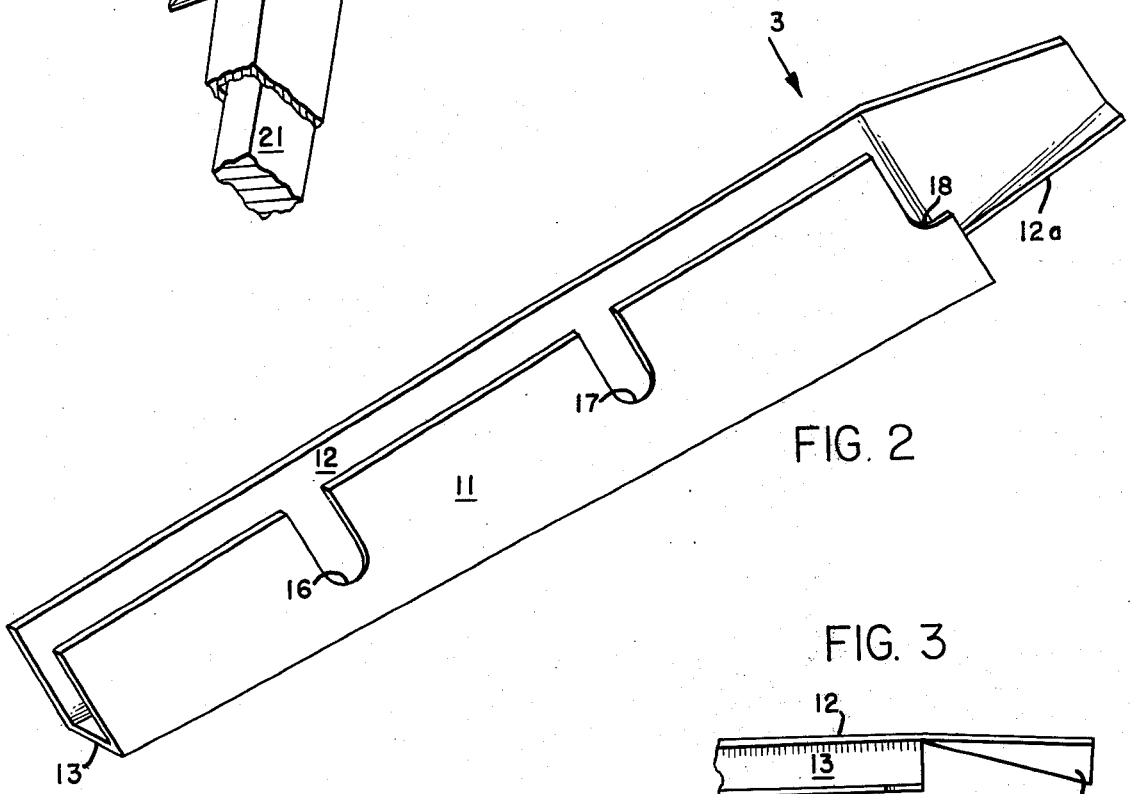
FIG. 2
FIG. 3
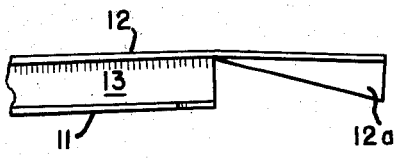
FIG. 5
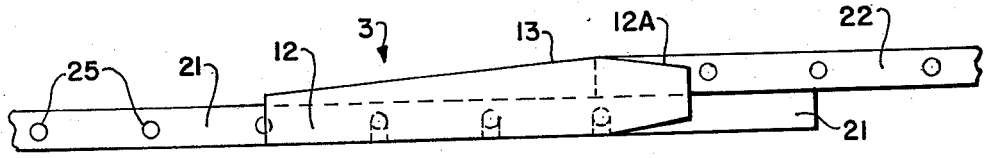

LADDER BRIDGING DEVICE

The present invention relates to a bridging assembly useful in connection with extension ladders when such ladders are used as a supporting track to support a hoist or the like which moves to and fro on the side rails of the ladder to move materials or personnel up and down the ladder.

The invention has as its principal object the provision of a bridging device which can be adapted for use with ladders having no special ladder design or structure to accommodate such a hoist.

In this connection, it will be observed that the problem of having the supporting members of the hoist properly co-operate with the ladder rails as the hoist travels to and fro has been recognized, and attempts to solve the problem have heretofore been made. Some of the solutions to this problem are shown in U.S. Pat. Nos. 1,106,698 and 3,428,145. In the first of these patents, a groove structure is incorporated into the side rails of the ladder to facilitate movement of the hoist from one section of the ladder to the other, while in the U.S. Pat. No. 3,428,145, hereinabove mentioned, a portion of the ladder rail itself is specially shaped as a sloped surface to provide a smooth bridging run for the hoist. In both these patents it will be noted that the ladder structure itself is specially designed.

The invention of the instant device departs from such practice by providing a uniquely distinct bridging member which is adaptable for use with ladders which are not specially designed with bridging structure and, of course, the device of the present invention may also be used in connection with ladders that are so specially designed.

The above principal object, as well as other objects and advantages of the invention will become readily apparent from the following description, taken in connection with the accompanying drawings wherein:

FIG. 1 is a view of a portion of an extension ladder equipped with the device of the present invention.

FIG. 2 is a perspective view of a bridging member illustrating the device of the present invention.

FIG. 3 is a view of a portion of the structure of FIG. 2, looking in the direction of the arrow 3 of FIG. 2.

FIG. 4 is a view of the ladder with a bridging device in operative position.

FIG. 5 is a side view of a bridging device connected to the rungs and side rails of the ladder.

A bridging device of the instant invention comprises a pair of side walls 11 and 12 joined together by a web portion 13. The side wall 12 is somewhat longer than the side wall 11, the extended portion of the side wall 12 projecting toward the side wall 11 to form a cam portion 12a.

The side wall 11 is provided with a plurality of cut-outs 16, 17, 18 along its length to co-operate with ladder rungs when the bridging member is in position on the ladder.

Two bridging devices as hereinabove described may be fitted on a ladder, one at each side of the ladder.

Referring to FIG. 2, it will be appreciated that the depth of the cut-outs 16, 17 are equal while the sidewalls 11, 12 are each tapered along their length. For example, the sidewall 11 will quite clearly be seen in FIG. 2, at its leftmost end, to have a vertical dimension lesser than the vertical dimension it has toward its rightmost end. This variation in vertical dimension is further illustrated in that the distance between the bottom portion of the cut-out 16 to the bottom of the sidewall 11, FIG. 2, is lesser than the distance from the bottom of the cut-out 17 to the bottom of the sidewall, FIG. 2.

FIG. 1 shows one side of a ladder equipped with a device of the present invention. The bridging member of FIG. 1 is fitted on the ladder as shown and will be maintained in position by the co-operation of the cut-out portions 16, 17, 18, with ladder rungs 25. The bridging member of FIG. 1 bridges the ladder members 21 and 22.

Referring to FIG. 1, it will be appreciated that the rungs 25 secured to the ladder side rail 21, as is well known in the art, will all be in the same plane. Thus, when a ladder bridging device of the instant invention is fitted over the side rail 21 such that the rungs 25 are engaged by the cut-outs 16, 17 the web surface 13 will form an inclined plane from the upper surface of member 21 to the upper surface of member 22, such that a wheel or roller passing, for example, downwardly, FIG. 1, along the upper surface of member 22 would, when it reaches the area of the cam portion **12*a* pass along both the lower end portion of the upper surface of member 22 and over the upper surface of the cam member 12*a* until it reaches the upper end of the web 13, whereupon the wheel or roller will now bear against the upper surface of web 13 and, because of the inclined plane (tapered) construction of the member 11, be guided along the plane down to the lower end of the web 13 to now bear against the upper surface of member 21**.

A suitable hoist assembly, not shown, will have rollers or wheels riding along the upper surfaces of the ladder rails and the web portion 13 of the bridging members as it travels to and fro along the ladder, and as will be appreciated, the sleeve members will facilitate a smooth passage of the hoist from one ladder section to another ladder section.

The rollers or wheels could be any appropriate wheel or roller assembly such as the roller assemblies shown in FIGS. 8 and 10 of Lyon U.S. Pat. No. 3,428,145, above cited or the traverse bearing rollers C′ at column 2, line 75 of Decker U.S. Pat. No. 363,950.

A latitude of modification, change and substitution is intended in the foregoing disclosure and in some instances some features of the invention will be employed without a corresponding use of the other features. Accordingly, it is appropriate that the appended claims be construed broadly and in a manner consistent with the spirit and scope of the invention herein.

Having thus described my invention, what I desire to protect by letters patent is:

1. A ladder bridging device having an elongated U-shaped structure, said structure having first and second side walls interconnected by a central web connecting wall, said first side wall having an end portion inclined at an angle thereto, wherein said second side wall has recesses formed therein to co-operate in supporting relationship with the rungs of a ladder structure, wherein said first and second side walls are of unequal length and are tapered longitudinally, and wherein said first side wall is longer than said second side wall.

* * * * *